US010569116B2

(12) United States Patent
Goodwin et al.

(10) Patent No.: US 10,569,116 B2
(45) Date of Patent: Feb. 25, 2020

(54) FIRE EXTINGUISHER AND FIRE EXTINGUISHER MEDIUM

(71) Applicant: Goodwin PLC, Stoke-on-Trent (GB)

(72) Inventors: Richard Stanley Goodwin, Stoke-on-Trent (GB); Andrew James Baylay, Stoke-on-Trent (GB)

(73) Assignee: Goodwin PLC, Stoke-on-Trent (GB)

( * ) Notice: Subject to any disclaimer, the term of this patent is extended or adjusted under 35 U.S.C. 154(b) by 0 days.

(21) Appl. No.: 14/387,535

(22) PCT Filed: Mar. 28, 2013

(86) PCT No.: PCT/GB2013/050833
§ 371 (c)(1),
(2) Date: Sep. 23, 2014

(87) PCT Pub. No.: WO2013/144644
PCT Pub. Date: Oct. 3, 2013

(65) Prior Publication Data

US 2015/0041159 A1 Feb. 12, 2015

(30) Foreign Application Priority Data

Mar. 30, 2012 (GB) ..... 1205733.7

(51) Int. Cl.
*A62D 1/00* (2006.01)
*A62C 99/00* (2010.01)
*A62C 13/00* (2006.01)

(52) U.S. Cl.
CPC ..... *A62D 1/0035* (2013.01); *A62C 13/00* (2013.01); *A62C 99/0009* (2013.01); *A62D 1/005* (2013.01)

(58) Field of Classification Search
CPC .... A62D 1/005; A62D 1/0014; A62D 1/0035; A62D 1/0028; A62D 1/0042; A62D 1/0057–0085; A62C 3/06; A62C 13/00; A62C 99/0009; A62C 99/0045; A62C 37/00–08; A62C 37/10–16; A62C 37/28–44
(Continued)

(56) References Cited

U.S. PATENT DOCUMENTS 3,238,129 A * 3/1966 Veltman ..... A62D 1/0014 252/7
4,425,465 A 1/1984 Padget et al.
(Continued)

FOREIGN PATENT DOCUMENTS

DE 23 53 491 A1 5/1975
DE 2353498 A1 * 5/1975 ..... A62D 1/0014
(Continued)

OTHER PUBLICATIONS

Specialty Vermiculite Corp., "MicroLite Product Line", 2013.*
(Continued)

*Primary Examiner* — Cody J Lieuwen
(74) *Attorney, Agent, or Firm* — Kilpatrick Townsend & Stockton LLP

(57) ABSTRACT

Fire extinguisher apparatus comprising at least one vessel containing a fire extinguishing medium and adapted to release said fire extinguishing medium when a fire or potential fire is identified characterised in that said fire extinguishing medium comprises an aqueous suspension of expanded vermiculite.

14 Claims, 1 Drawing Sheet

(58) Field of Classification Search
USPC ..... 169/45; 252/2
See application file for complete search history.

(56) References Cited

U.S. PATENT DOCUMENTS

| | | | | |
|---|---|---|---|---|
| 5,102,464 | A * | 4/1992 | Ou | C04B 14/208 106/415 |
| 6,309,740 | B1 * | 10/2001 | Shu | C04B 14/208 252/605 |
| 2011/0290510 | A1 * | 12/2011 | Hanratty | A62C 13/64 169/74 |

FOREIGN PATENT DOCUMENTS

| | | | | |
|---|---|---|---|---|
| FR | 2935907 | A1 * | 3/2010 | A62D 1/0014 |
| JP | S52137200 | | 1/1977 | |
| JP | S58176165 | A | 10/1983 | |
| JP | S6063359 | U1 | 5/1985 | |
| JP | H07558 | A | 1/1995 | |
| JP | H09295809 | A | 11/1997 | |
| JP | S2010527887 | A | 8/2010 | |
| RU | 2050873 | C1 | 12/1995 | |
| SU | 1644980 | A1 | 4/1991 | |
| WO | 2004/002575 | A1 | 1/2004 | |

OTHER PUBLICATIONS

International Search Report and Written Opinion corresponding to PCT/GB2013/050833 dated Jun. 4, 2013, 7 pages.
Search Report corresponding to GB1205733.7 dated Jul. 18, 2012, 3 pages.
Office Action issued in corresponding to Japanese Application No. JP2015-502456 dated Mar. 28, 2017, 6 pages.
Aqueous Vermiculite Dispersion, dupre Minerals, http://www.dupreminerals.com/en/products/vermiculite-dispersion, Mar. 14, 2012.
Office Action corresponding to Russian Application No. 2014141015/05 dated Jan. 31, 2017, 11 pages.

* cited by examiner

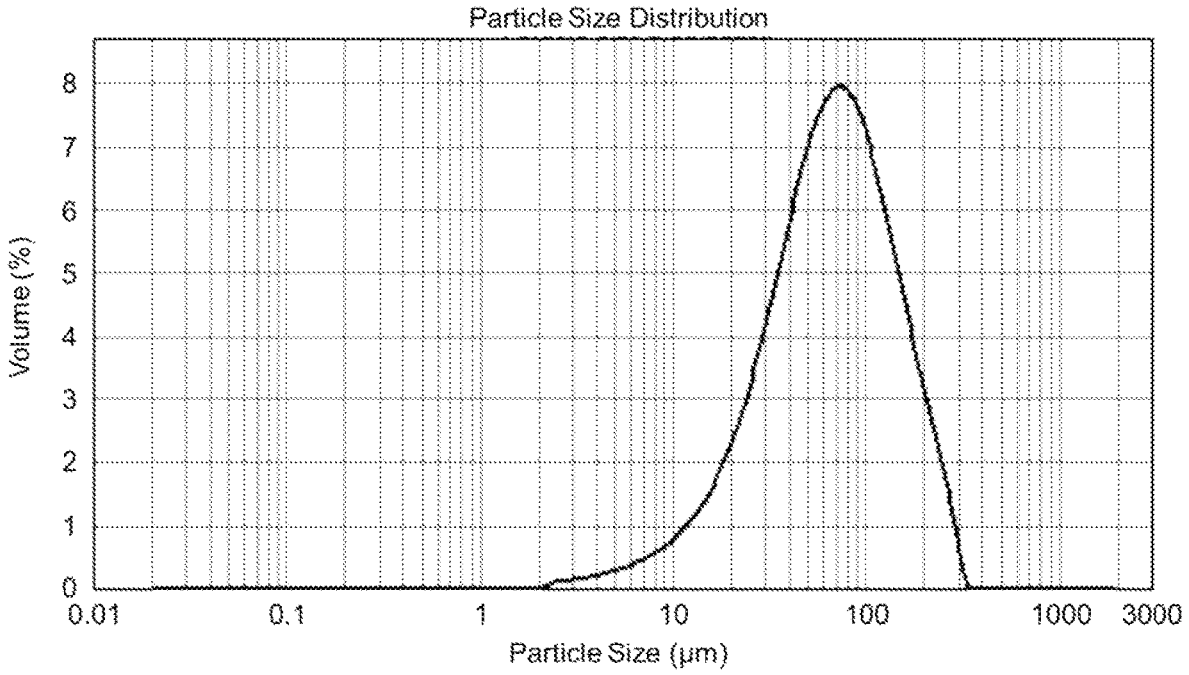
Particle Size Distribution
Volume (%)
0
1
2
3
4
5
6
7
8
0.01
0.1
1
10
100
1000
3000
Particle Size (μm)

FIRE EXTINGUISHER AND FIRE EXTINGUISHER MEDIUM

The invention relates to the use of an aqueous suspension of fine expanded vermiculite particles as a fire extinguishing medium and to fire extinguishing equipment containing such a suspension.

Vermiculite is a naturally occurring mineral of chemical formula $(Mg,Fe,Al)_3(Al,Si)_4O_{10}(OH)_2.4H_2O$. Vermiculite may be expanded by heat or chemical treatment to form exfoliated vermiculite.

Exfoliated vermiculite particles may be suspended in a stable aqueous suspension, for example as disclosed in U.S. Pat. No. 6,309,740. Aqueous suspensions of expanded vermiculite have been used for fireproofing flexible materials such as paper and cloth.

Vermiculite has also been used mixed with plaster to form a fire resistant coating.

FR 2 935 907 contemplates controlling fire by forming in situ a mixture of plaster with water in a weight ratio of 1 to 10 to form a sprayable liquid which is applied by spraying. In one embodiment FR 2 935 907 contemplates further in situ mixing of the plaster and water mixture with an inflammable granular mineral material with a density of less than 1, for example vermiculite, to form a mixture which can float on the surface of a burning liquid. Such a mixture once made could not be stored ready for use over an extended period.

The present invention relates to the use of an aqueous suspension of fine expanded vermiculite as a fire extinguishing material and to fire extinguishing equipment containing such a suspension. Preferably the vermiculite is present at between 3% and 40% by weight, more preferably 10% to 30% especially 15% to 25% such as about 20%. The vermiculite is preferably very fine with particle size between nanometre to 1000 micrometres and preferably not greater than 300 micrometres. While an aqueous suspension of vermiculite with no additional additives provides an excellent extinguisher medium the suspension may additionally include other additives such as suppressants conventionally used in fire extinguisher systems to enhance performance provided that they do not interfere with the ability of the vermiculite to remain in suspension over an extended period. Preferably the vermiculite will remain in suspension if left undisturbed for a period of at least 6 months at room temperature such as at between 10 to 30 degrees centigrade, for example at 20 degrees centigrade, more preferably at least 12 months especially 24 months or more.

Conventional fire extinguishers rely on one or more of the following three principles:

(1) Water based: The application by spraying of water to douse the flames and to cool the area on fire to below the ignition point so as to extinguish the flames;

(2) Dry powder or foam: Surrounding the area on fire with a wet foam or a dry powder to douse the flames and to starve the fire of oxygen so as to extinguish the flames;

(3) $CO_2$: Removing oxygen from the area of the fire so that combustion can no longer take place, for example using propelled Halon gas or dry ice $CO_2$.

Controlling a fire by spraying a water based dispersion of very fine expanded vermiculite onto the area of the fire controls the fire in five ways, effectively combining and extending the individual benefits provided by the different types of conventional extinguishers:

(1) The water in the suspension and trapped within the vermiculite particles lowers the temperature of the area on fire by absorption of the latent heat of vaporisation and helps to extinguish the fire;

(2) The suspension forms an excellent insulating layer, insulating the hot area of the fire, which otherwise, although cooled by (1), may radiate and spread to adjacent areas not already on fire;

(3) The suspension forms a protective insulating fire resistant coating over the adjacent area not on fire that prevents any burning material landing on the area from an area on fire from starting a fire on the combustible material under this coating;

(4) Vermiculite of very fine particle size creates an oxygen barrier between the combustible material that has not yet caught fire and the oxygen in the adjacent atmosphere that is needed for combustion to take place.

(5) The platelet structure of the vermiculite particles holds water and wets up well. This results in the fine particles sticking to the object, clothing or flesh to provide an improved dousing effect and to build up an insulation barrier. This contrasts with water which bounces off and drains away. The vermiculite suspension is also much better that foam or powder extinguishing material in sticking to a vertical object. The vermiculite suspension forms an excellent thermal insulation layer.

Typically a first aid measure for flesh burns may include isolating the burn from oxygen. Very fine vermiculite particles when applied in a spray may form an oxygen barrier layer so that use of the vermiculite dispersion to extinguish a fire affecting a person or animal may additionally provide an initial oxygen blocking protective layer for burnt skin as well as extinguishing the fire and providing an insulating layer against further fire or heat.

The invention will be more clearly understood from the following description and FIGURES given by example only in which:

FIG. 1 is an illustrative size distribution chart for Vermiculite Dispersion DM38 from Dupré Minerals Limited.

Vermiculite dispersions such as DM38 from Dupré Minerals Limited are available with expanded vermiculite in controlled particle size ranges. The vermiculite is capable of being retained in suspension in such dispersions for extended periods for months or a year or two years or more. DM38 from Dupré Minerals Limited has a size distribution for illustrative purposes set out in FIG. 1. The particles range from nanometre sizes to 1000 micrometres with the majority of the vermiculite being around 300 micrometres in size. For use as a fire extinguisher medium the particle size distribution should be such that the vermiculite may be maintained in suspension over an extended period, will provide a suitable spray when administered from conventional fire extinguisher equipment, will maintain a good coating ability when sprayed and will provide a good thermal insulation and oxygen barrier properties when sprayed in a fire extinguishing situation. Vermiculite particle sizes in a range of up to 2000 micrometres preferably less than 1000 micrometres and more preferably 300 micrometres or less are suitable for this purpose. Preferably at least 90% by weight and more preferably 95% by weight of the vermiculite particles should be no larger than 300 micrometres and more preferably between 1 and 300 micrometres. Vermiculite may be present in a suitable suspension at between 3% and 40% by weight, preferably 10 to 30% and more preferably 15% to 25% especially about 20%.

While an aqueous suspension of vermiculite with no additional additives and especially a suspension in deionised or distilled water provides an excellent extinguisher medium the suspension may additionally include other additives such as suppressants conventionally used in fire extinguisher systems to enhance performance and additives to enhance stability of the suspension. The additives should preferably not adversely interfere with the ability of the vermiculite to remain in suspension over an extended period and preferably should not interfere with the ability of the suspension when sprayed to form a protective fire resistant and thermal insulating coating. A mixture of plaster, water and vermiculite prepared in accordance with FR 2 935 907 will not be a stable suspension. Preferably there is no plaster or less than 10% by weight such as less than 5% by weight or less than 1% by weight plaster present in the extinguisher medium.

The fire extinguishing medium may be provided in any suitable container which permits its rapid application to a fire and its surrounding area or to an area at risk in the event of a fire or potential fire being identified either by manual operation or automatically in response to an alarm or other signal. A suitable container which may be filled with a fire extinguishing medium comprising an aqueous suspension of fine expanded vermiculite may be made of any suitable material such as metal, polymer, carbon fibre, glass or Kevlar and is preferably capable of being pressurised or pumped out so as to omit a spray from a hose or other outlet. Examples of suitable vessels include:

a hand portable vessel preferably of from 0.125 to 50 litres (0.25 to 40 Kg fluid content). The vessel may be a stored pressure or cartridge operated fire extinguisher of the type conventionally used as a portable water extinguisher;

a semi portable extinguisher optionally on wheels form 5 litres to 250 litres capacity;

a tank with a pump or pressurised gas source mounted in or on a fire engine or towable behind a vehicle;

cylinders or tanks either as individuals or as a bank located in close proximity to or remotely from a fire hazard area and in each case adapted to release their contents on to the fire hazard area.

The following examples illustrate the benefits of vermiculite suspension as a fire extinguishing material.

EXAMPLE 1

An aqueous solution of chemically exfoliated vermiculite having a controlled size distribution as illustrated in FIG. 1 was prepared. Such a suspension is commercially available from Dupré Minerals Limited under the name "Aqueous Vermiculite Dispersion (DM38)".

EXAMPLE 2

A number of conventional water based gas pressurised extinguishers were filled with an aqueous vermiculite suspension in accordance with example 1. When activated the extinguishers released the vermiculite suspension in a spray through the extinguisher hose.

EXAMPLE 3

A dummy was set up and dressed in a flammable high visibility jacket. The jacket was lit using a Bunsen burner. When the jacket was on fire an extinguisher filled with vermiculite suspension in accordance with example 2 was activated and the spray directed onto the burning jacket. The spray formed a coating on the jacket which rapidly extinguished the flame.

EXAMPLE 4

An attempt was made to reignite the jacket of Example 3 by applying the burner to the jacket in an area which had been coated with the spray of vermiculite dispersion. The jacket would not reignite.

EXAMPLE 5

The experiments of Experiment 3 and 4 were repeated using just water in the extinguisher. The water doused the fire although it took a longer spraying time to achieve this. Further water was then applied to thoroughly soak the jacket. When the burner was reapplied to the soaked jacket it reignited within a few seconds.

EXAMPLE 6

A vermiculite dispersion was applied from a fire extinguisher of example 2 from a distance of approximately 2.5 metres to an upright butane gas cylinder. The dispersion formed a coating over the cylinder. In the event of a fire the application of such a coating to a gas containing vessel provides an excellent fire resistant and thermal insulation layer to reduce the chance of a violent explosion as the contents of the cylinder are exposed to increasing levels of heat and fire.

The invention claimed is:

1. A method of extinguishing a fire, said method comprising: applying to the fire a fire extinguishing medium comprising a stable aqueous suspension of fine chemically exfoliated vermiculite, wherein said chemically exfoliated vermiculite suspension comprises vermiculite in a particle size range of from 1 nanometer to 2000 micrometers.

2. The method of claim 1 wherein said chemically exfoliated vermiculite suspension comprises vermiculite with a maximum particle size of 300 micrometers or less.

3. The method of claim 1 wherein said chemically exfoliated vermiculite suspension comprises vermiculite at between about 3% and about 40% by weight.

4. The method of claim 1 wherein said chemically exfoliated vermiculite suspension comprises vermiculite at between about 10% and about 30% by weight.

5. The method of claim 1 wherein said chemically exfoliated vermiculite suspension comprises vermiculite at between about 15% and about 25% by weight.

6. The method of claim 1 wherein said chemically exfoliated vermiculite suspension comprises vermiculite at about 20% by weight.

7. The method of claim 1 wherein said fire extinguishing medium remains stable in storage with the vermiculite remaining in suspension for a period of at least 6 months.

8. The method of claim 1 wherein said fire extinguishing medium remains stable in storage with the vermiculite remaining in suspension for a period of at least 12 months.

9. The method of claim 1 wherein said fire extinguishing medium remains stable in storage with the vermiculite remaining in suspension for a period of at least 24 months.

10. A method of extinguishing a fire, said method comprising: applying to the fire a fire extinguishing medium comprising a stable aqueous suspension of fine chemically exfoliated vermiculite wherein said chemically exfoliated vermiculite suspension comprises vermiculite in a particle size range of from 1 nanometer to 2000 micrometers, wherein said fire extinguishing medium is applied from one or more apparatus comprising at least one vessel containing said fire extinguishing medium and adapted to release said fire extinguishing medium when a fire is identified.

11. The method of claim 10 wherein the one or more apparatus is manually operated.

12. The method of claim 10 wherein the one or more apparatus is adapted to automatically release the fire extinguishing medium responsive to a signal indicating that a fire has been detected.

13. The method of claim 10 wherein the one or more apparatus comprises an outlet for releasing said fire extinguisher medium as an intermittent or continuous spray and directing said spray to a selected area.

14. A method of extinguishing a fire, said method comprising:

(i) providing a vessel adapted to release a fire extinguishing medium;

(ii) fully or partially filling said vessel with a fire extinguishing medium comprising a stable aqueous suspension of fine chemically exfoliated vermiculite wherein said vermiculite suspension comprises vermiculite in a particle size range of from 1 nanometer to 2000 micrometers; and (iii) applying said fire extinguishing medium to the fire from an apparatus comprising said vessel.

* * * * *